US009157710B1

(12) United States Patent
Huntsman

(10) Patent No.: US 9,157,710 B1
(45) Date of Patent: Oct. 13, 2015

(54) ARCHERY BROADHEAD SYSTEM

(71) Applicant: Shane Darin Huntsman, North Salt Lake, UT (US)

(72) Inventor: Shane Darin Huntsman, North Salt Lake, UT (US)

( * ) Notice: Subject to any disclaimer, the term of this patent is extended or adjusted under 35 U.S.C. 154(b) by 0 days.

(21) Appl. No.: 14/586,568

(22) Filed: Dec. 30, 2014

Related U.S. Application Data

(60) Provisional application No. 61/922,226, filed on Dec. 31, 2013.

(51) Int. Cl.
*F42B 6/08* (2006.01)
*F42B 12/02* (2006.01)

(52) U.S. Cl.
CPC .. *F42B 6/08* (2013.01); *F42B 12/02* (2013.01)

(58) Field of Classification Search
CPC ..... F42B 6/04; F42B 6/08
See application file for complete search history.

(56) References Cited

U.S. PATENT DOCUMENTS

| | | | | |
|---|---|---|---|---|
| 3,653,664 | A * | 4/1972 | Gentellalli | F42B 6/08 473/583 |
| 4,210,330 | A * | 7/1980 | Kosbab | F42B 6/08 473/584 |
| 5,636,845 | A * | 6/1997 | Newnam | F42B 6/08 30/344 |
| 6,695,726 | B1 * | 2/2004 | Kuhn | F42B 6/08 473/583 |
| 7,182,706 | B2 * | 2/2007 | Barrie | F42B 6/08 473/584 |
| 7,871,345 | B2 * | 1/2011 | Cooper | F42B 6/08 473/584 |
| 7,942,765 | B2 * | 5/2011 | Odabachian | F42B 6/08 473/583 |
| 8,100,788 | B2 * | 1/2012 | Sanford | F42B 6/08 473/582 |
| 8,771,113 | B2 * | 7/2014 | Patton | F42B 6/08 473/583 |
| 2009/0191991 | A1 * | 7/2009 | Roberts | F42B 10/08 473/583 |

* cited by examiner

*Primary Examiner* — John Ricci
(74) *Attorney, Agent, or Firm* — J. Todd Rushton

(57) ABSTRACT

The present invention relates to an archery broadhead system or more specifically to an archery broadhead having primary blades that are axially offset from the central axis of the arrow and having cutting paths that are connected by a central bleeder blade. The archery broadhead of the present invention creating a "Z" shaped penetration.

20 Claims, 8 Drawing Sheets

ARCHERY BROADHEAD SYSTEM

The present application claims priority to U.S. Provisional Application 61/922,226 filed Dec. 31, 2013, the disclosure therein incorporated by reference.

BACKGROUND

The present invention relates to an archery broadhead system or more specifically to an archery broadhead having primary blades that are axially offset from the central axis of the arrow and having cutting paths that are connected by a central bleeder blade. The archery broadhead of the present invention creating a "Z" shaped penetration.

Early in the evolution of hunting, man certainly recognized that a sharpened stick could be used to harvest an animal, and somewhere shortly thereafter, they found that by attaching a shaped stone point to the stick, a larger more lethal opening could be inflicted. This allowed them to more effectively harvest game, challenge larger animals and ultimately allow the species of man to survive. This record is clearly recorded in petroglyphs, rock painting and the numberless obsidian, slate and flint arrowheads scattered across the globe. The obsidian points of Neolithic man and the American Indians are the ancient predecessors of the modern broadhead.

Modern two blade broadhead points are typically triangular in shape with the point in front and extending back toward the arrow shaft. The broadhead blades are razor sharp and approximately two inches long and an inch wide at the base, this shape allows for maximum penetration into the animals vital organs; the planer blades slicing through blood vessel and veins and opening a large wound path which allows the animal to "bleed out" quickly and die with minimal suffering. However, since the two blade broadhead creates a substantially planer cutting path, the blades may enter the animal aligned parallel with surface of an organ or, length of a vein, and may pass very close to the vital structure without actually cutting into the structure and creating the necessary bleeding for a quick kill. Because of this issue, there are broadhead points that have three or four fixed blades, or replaceable "bleeder blades", which create an off plane cutting path to intercept vital structures as the arrow penetrates the animal.

Also, when analyzing broadhead cutting paths and effectiveness, it logically occurs that a wider broadhead will create a larger cutting path, with a higher likelihood of intercepting vital structures. However, there are limitations to broadhead width, if a broadhead becomes too wide the surface area of the broadhead will have a propensity to steer the arrow and create a less accurate or even unpredictable flight. To overcome this, the industry has introduced numerous mechanical broadhead points, having one or more blades that retract against the broadhead body or ferrule and mechanically extend to wide cutting width once the arrow impacts the target, such as the broadhead point of US Patent Application 20140155202, filed Mar. 15, 2013 by Young. However, the limitations of this type of broadhead include durability once the moving blades have contacted a target, difficulty in manufacture and overall cost of the broadhead.

The durability issue also arises when a broadhead point strikes a heavy bone in the animal. Most blades or points will slice through rib bones and will cause a heavy bone such a leg bone or hip to fracture. These strikes may be effective at stopping a large animal but will cause a broadhead with replaceable blades to come apart, leaving a lost blade or portion of blade in meat that is intended for consumption and again broken blades are a cost consideration. Also, if a bone is struck on entry and the replaceable blades are broken off, the remaining ferrule point will no longer effectively cut a wound channel as the arrow penetrates and the wounded animal may be lost. There are some heavy cast or forged broadhead points that are designed to break through bone, such as, the point of U.S. Pat. No. 8,771,113, filed Feb. 5, 2013 issued to Patton. Weight versus the overall size and cutting path of the broadhead may become an issue.

What is needed is an archery broadhead system that creates an effective cutting path, has effective penetration, accurate, easily manufactured and durable.

SUMMARY OF THE INVENTION

The present invention is an archery broadhead having primary blades that are offset from the central axis of the arrow and a central bleeder blade that intersects with the base portion of the primary blades. This configuration creates maximum wound size with a reduced in-flight profile. The offset primary blades in conjunction with a unidirectional edge bevel create a degree of twist when the arrow is flying through the air, this twist is design to compliment the twist provided by the arrow fletching and create a more accurate flight. An arrow fletched with a left hand twist would be complimented using a broadhead of the present invention where (when viewed from the point) the profile of the blade forms substantially a "Z" shape, whereas, an arrow with a right hand twist would be complimented by a broadhead with the opposite configuration or the profile of the blade forms the mirror image of a "Z" shape. Additionally, when the primary blades are sharpen with a unidirectional bevel that opens, or is slanted, to the outside, the bevel will create a torsional force when the broadhead strikes a viscous target, such as the body cavity of a large animal, the torsional force causes the broadhead rotate within the target. This rotation within the target optimizes the wound opening, increases the chance of intercepting a vital structure and creates a higher percentage of lethal strikes. Additionally, the configuration of at least one embodiment of the broadhead of the present invention, causes hide and tissue to twist around the secondary bleeder blade point prior to being intercepted by the cutting edge of the primary blades, this effect creates a large irregular wound opening through heavy skin or hide and optimizes bleeding. The wound opening formed by the present invention is much more effective at creating bleeding versus a straight cut or "X" cut of a more traditional broadhead. The twisting effect of the secondary bleeder blade also has a propensity to "drill" when entering a large bone and creates a strong torsional moment once the primary blades make contact with the "drilled" opening at the surface of the bone, the torsional moment will cause bone to facture in most instances. The broadhead of the present invention can be formed using a single blade that has been folded into the offset configuration, can be formed using multiple replaceable blades attached to a specifically formed ferrule, may be a cast material, maybe injection molded, or maybe formed from a unitized piece of stock material using CNC machining.

One embodiment of the present invention or archery broadhead system includes a single blade having primary cutting surfaces or blades that are offset from the central axis of the arrow shaft and a secondary cutting surface or blade that runs substantially parallel to the primary blades between the base portions of the primary blades. The single blade is formed, as substantially a triangle having a central axis running through the tip of the triangle to the mid-point of the base; the triangle is cut or stamped out of a high tensile steel blank that is folded along lines parallel to the central axis; there is a single fold on each side of the triangle forming the primary cutting surfaces which project in opposite directions from the central secondary cutting surface. When looking at the folded blade along the central axis, the profile of the blade will form substantially a "Z". In one embodiment the fold between the primary blades and the central secondary blade forms a right angle or 90 degrees, in another embodiment the angle formed is less than 90 degrees and in yet another embodiment, the angle formed between the primary blades and the central secondary blade is more than 90 degrees. In one embodiment the folds having a large radius, forming an "S" shaped blade. In one embodiment, the single blade is a solid piece of steel, in other embodiments the solid piece of steel has windows cut out that substantially mirror the shape of the primary cutting blades, the cut outs, act to reduce the overall weight of the blade and reduce the surface area where air and wind can affect the accuracy of the arrow. In one embodiment the single blade is sharpen, prior to folding, with a single bevel along the leading edges of the triangle; the single bevel facing in opposite directions on each side of the triangle, but will be facing outward following the folding operations. In another embodiment, the leading edge will be sharpened with a double bevel. In yet another embodiment, the leading edge will be sharpened after the folding operation. In one embodiment the trailing edge of the blade will be sharpened. It is recognized that the folded blade of the present invention is substantially more rigid and stronger than a planer blade of the same thickness. This can be described in the same manner as folds or ridges are formed in a sheet of corrugated steel in order to shift the bending moment within the steel or by folding a sheet of paper into alternate pleats a text book of substantial weight can be supported on the edge of the paper.

The single blade is attached to a ferrule assembly having a central slot configured to receive and retain the central secondary blade portion. The blade can be retained using set screws or pins, or may be adhesively attached or welded. The ferrule portion may include a threaded post configured to screw into a matching ferrule insert which is placed on the inside of a hollow arrow shaft or the ferrule portion may include a cone structure configured to be adhesively attached to a traditional cedar arrow.

In other embodiments of the present invention, the triangular steel blank is folded along lines which are not parallel to the central axis; in each embodiment there is a single fold on each side of the triangle forming the primary cutting surfaces which project in opposite directions from the central secondary cutting surface. However in a first embodiment the folds create a central blade which is wider near the point of the blade and narrower at the base. In a second embodiment the folds create a central blade that is narrower near the point and wider at the base. It is contemplated that this configuration will create greater twist or spin when flying through the air. It is also recognized increased spin or twist can be accomplished by adjusting or bending the trailing or base edge of the primary blades.

In one embodiment, tertiary bleeder blades may be mechanically attached to the folded primary blade to increase the cutting path and blade effectiveness. The primary blade having an alignment slot through which the tertiary blades are inserted and the tertiary blade secured using the primary blade set screws.

In yet another embodiment, it is contemplated the "Z" cutting pattern is created using a plurality of removable blades. The ferrule assembly having flat sides, or shaped indentations where the primary blade can be mechanically attached and a slot in the point of the ferrule configured to secure the central secondary blade. It is understood that the broadhead formed using multiple blades will have a similar game stopping performance to a single piece blade but have the advantages of replacing only one blade segment at time, or removing a single blade for sharpening in the case of blade damage.

These and other features and advantages of the disclosure will be set forth and will become more fully apparent in the detailed description that follows and in the appended claims. The features and advantages may be realized and obtained by the instruments and combinations particularly pointed out in the appended claims. Furthermore, the features and advantages of the disclosure may be learned by the practice of the methods or will be obvious from the description, as set forth hereinafter.

BRIEF DESCRIPTION OF THE DRAWINGS

The following description of the embodiments can be understood in light of the Figures, which illustrate specific aspects of the embodiments and are part of the specification. Together with the following description, the Figures demonstrate and explain the principles of the embodiments. In the Figures the physical dimensions of the embodiment may be exaggerated.

DETAILED DESCRIPTION OF THE DRAWINGS

Definitions

Broadhead—a triangular archery point primarily for hunting having a point and at least two primary blades that taper back to the arrow shaft.

Bleeder Blade—a secondary blade that extended substantially perpendicular to the primary blade, the bleeder blade may be a permanent blade or is a replaceable insert.

Ferrule—support structure for the broadhead blade, the ferrule may include a threaded shaft or may have a conical receiver for traditional arrows.

Ferrule Insert—usually a threaded aluminum insert that is glued inside of a hollow arrow shaft and configured to receive the threaded shaft of the ferrule.

Arrow Shaft—the long cylindrical body of the arrow, typically shaped from wood such as cedar and pine, or in modern arrows the shaft is aluminum, fiberglass, graphite, aramid or a composite.

Fletching—traditionally turkey or other natural feather attached at the rear of the shaft, however modern fletching is typically an elastomeric material such as vinyl or nylon.

Twist—noun: aligning the fletching a few degrees across the central axis of the of the arrow shaft in order to create rotation of the arrow during flight and increase the arrow accuracy (similar to rifling in a gun barrel), verb: the act of the arrow spinning in flight or rotating upon impact.

"Z" Shaped Blade—when viewed from along the central axis, extending from the point to the base, the profile of the blade or a combination of blades form essentially the letter "Z" or the mirror image of the letter Z.

"S" Shaped Blade—when viewed from along the central axis, extending the from the point to the base, the profile of the blade form essentially the letter "S" or the mirror image of the letter S. The bend or direction changes in the blade including an open radius to create the S configuration.

Single Bevel Edge—sharpening on a single taper from the front surface to the back surface forming essentially a chisel point.

Double Bevel Edge—sharpening with a taper toward the center of the material from the front surface and the back surface forming an edge.

Viscous Material—a soft material with a high fluid content or a material that reacts like organic flesh upon impact of a projectile such as a broadhead.

These definitions are for general understanding of the application of the present invention and should not be construed as limitations on the application or to replace accepted definitions in the archery arts.

Figure 1:
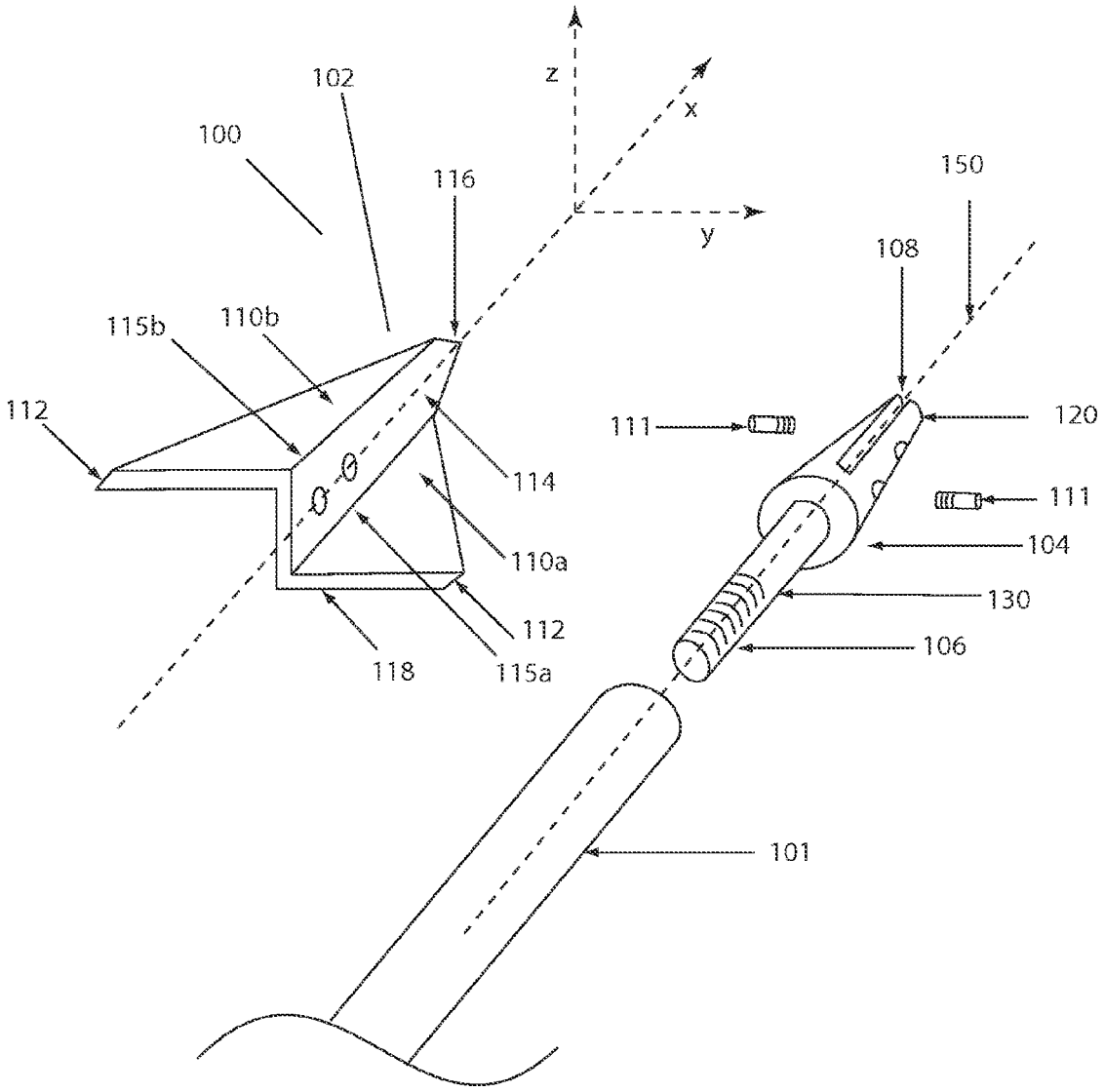
FIG. 1 one embodiment of the archery broadhead.

FIG. 1 is a perspective view illustrating one embodiment of the broadhead system 100 of the present invention. Generally the broadhead system 100 is capable of use with an arrow shaft 101 for hunting large game animals. The goal of the hunter is to accurately place a shot in the target animal's vital organs with maximum penetration. In the situation where the hunter is targeting a big game animal, the objective of the hunter is to quickly kill the animal by causing excessive hemorrhaging, and thereby avoid unnecessary tracking and prolonged suffering by the animal.

The broadhead system 100, of the present invention, creates additional arrow twist or rotation and a more stable flight path and torsional force when passing through viscous material, providing a twisting cutting motion once the broadhead system 100, enters an animal. The broadhead system 100, in one embodiment, includes a broadhead tip 102 and a detachable ferrule 104. The ferrule 104 is configured to couple the broadhead tip 102 with an arrow shaft 101. In one embodiment the ferrule 104 is formed with a threaded rod portion 106. The arrow shaft 101 may be formed with ferrule insert (not shown) configured to receive the rod portion 106 of ferrule 104. In each embodiment the ferrule 104 has a detachment end 130 and a central axis 150 running from the point 120 to the detachment end 130. The ferrule 104, in some embodiments, is formed of a metal such as steel, aluminum or titanium or may be a rigid polymer, such as, polycarbonate. In one embodiment, the ferrule 104 includes a slot 108 formed at the point or tip 120 for receiving and securing a compound broadhead tip or blade 102. The broadhead blade 102 is secured using fasteners 111, wherein fasteners 111 may be set screws or drift pins that pass through an opening in ferrule 104 and through reciprocal openings formed in blade 102. In one embodiment, the threaded rod potion 106 of ferrule 104 is replaced with a conical structure configured to receive a tapered potion of a traditional wooden arrow shaft.

The broadhead blade 102 may be formed using a cut or stamped sheet metal blank that is bent into a compound configuration having a point 116, a central secondary bleeder blade 114 having a substantially planer area, and primary blades 110*a* and 110*b*. In one embodiment, the secondary bleeder blade 114 is folded along line 115*a*, 115*b* at about one half the width as the width of the primary blades 110*a* and 110*b*, in another embodiment, the blades 114, 110*a*, and 110*b* may divide the blank into equal thirds. In other embodiments the blade proportions may be different in order to achieve different flight, penetration or cutting ability. In one embodiment, the folds between the substantially planer secondary bleeder blade 114 and the primary blades 110*a* and 110*b* create substantially a right or 90 degree angle, in another embodiment the fold may be greater than 90 degrees or the folds may create an acute angle, less than 90 degrees. It is recognized that the fold angle can affect the arrow flight characteristics. As shown, the designated axes x, y and z are as follows; axis x in the depicted embodiment, is a central longitudinal axis that extends along the center of the broadhead system 100, from point 116 of the broadhead head blade 102 through the ferrule 104 and arrow shaft 101.

In one embodiment, the planar surfaces of the primary blades 110*a*, 110*b* are parallel with reference to each other. In other words, the distance between primary blades 110*a*, 110*b*, as measured along the secondary bleeder blade 114, is consistent from the tip 116 to the tail 118 of the broad head blade 102. In other embodiments, the primary blades 110*a* and 110*b* are offset in reference to the other blade and the x axis or in other word are not parallel to each other. In one embodiment, the blade diverge form the tip or point 116 to the tail 118. In another embodiment the primary blades converge from a wider arrangement proximate the point 116 and converge near the tail 118 of the broadhead blade 102.

In the depicted embodiment, the secondary blade 114 tapers to a sharpened point 116. The sharpened point 116 is configured to cut into, penetrate a target and gather tissue before it is cut by primary blades 110*a* and 110*b*. The primary blades 110*a*, 110*b*, and the sharpened point 116 may be configured with a knife like cutting edge 112. In one embodiment the cutting edge 112 is configured to induce torsional force or twisting when the broadhead 102 enters a viscous target. This is accomplished by using opposing single bevel edges 112 that face outward in opposing directions, when the broadhead 102 enters a target, forces tangential to the surface of edge 112 are exerted and create additional twist within the target animal.

Figure 2A:
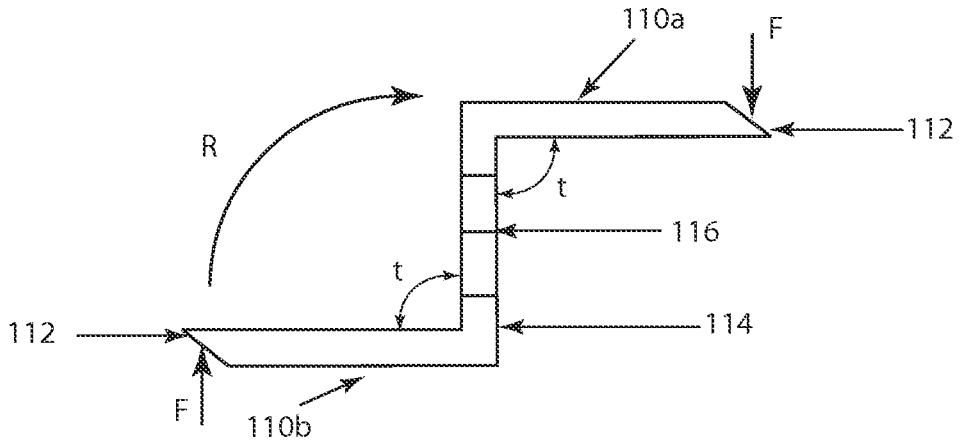
FIG. 2A-2C are point profiles of the archery broadhead.
Figure 2B:
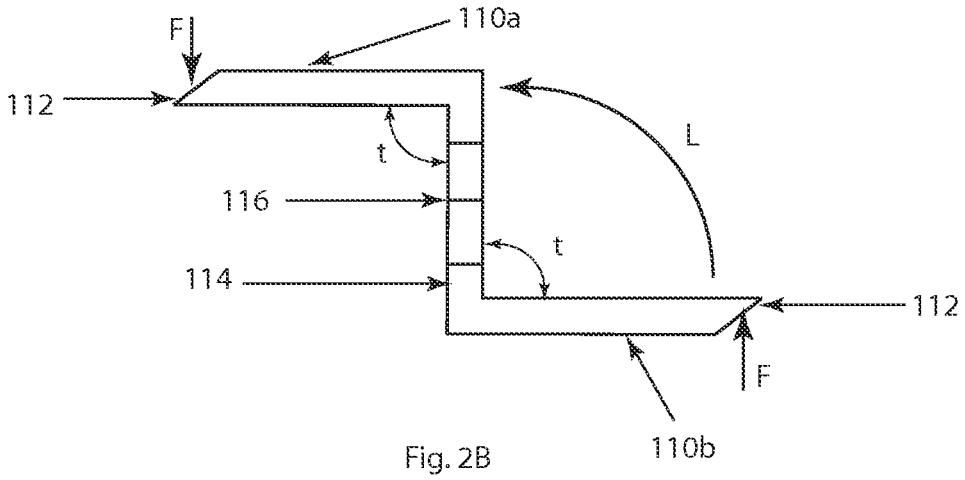
Figure 2C:
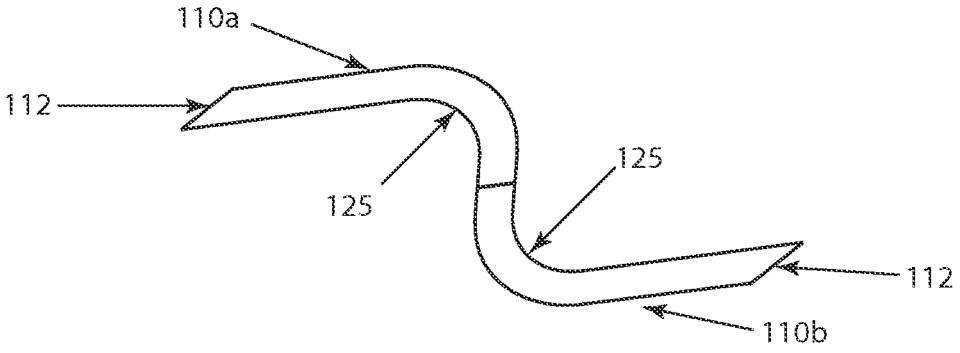

FIGS. 2A, 2B and 2C are front views of the broadhead tip 102 in accordance with embodiments of the present invention. FIGS. 2A and 2B are broadhead tips 102 having, a point 116, secondary cutting blade section 114, primary blades 110*a*, 110*b* and cutting edges 112. The primary blades are bent in a parallel configuration with angle T formed as a right angle, the single bevel edge 112 of FIG. 2A will create a tangential force F when traveling through a viscous material and induce a left hand twist, whereas, as shown in FIG. 2B, the tangential force imparted on edge 112 will create a right hand twist. As shown in FIG. 2C, the broadhead tip 102 having open bends or radii 125 forming an "S" shape between the primary blades 110*a*, 110*b* and secondary blade 114. The edge bevels 112 are continuous from point 116 to the trailing edge of the primary blades 110*a* and 110*b*. In other embodiments the edge bevel 112 may be a double bevel producing an edge central to the blade 102 material, however, it is recognized that a central edge will create offsetting tangential force and will not impart additional torsion or twist when the arrow enters a viscous target.

Figure 3A:
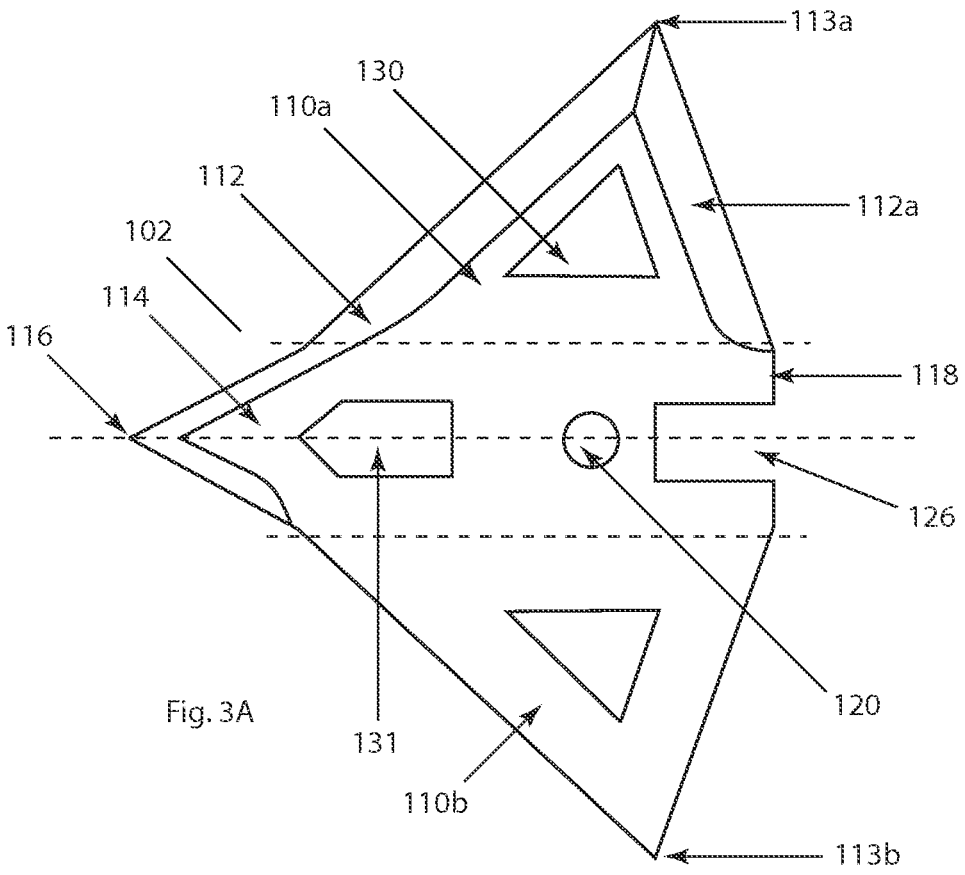
FIG. 3A material blank of the archery broadhead.
Figure 3B:
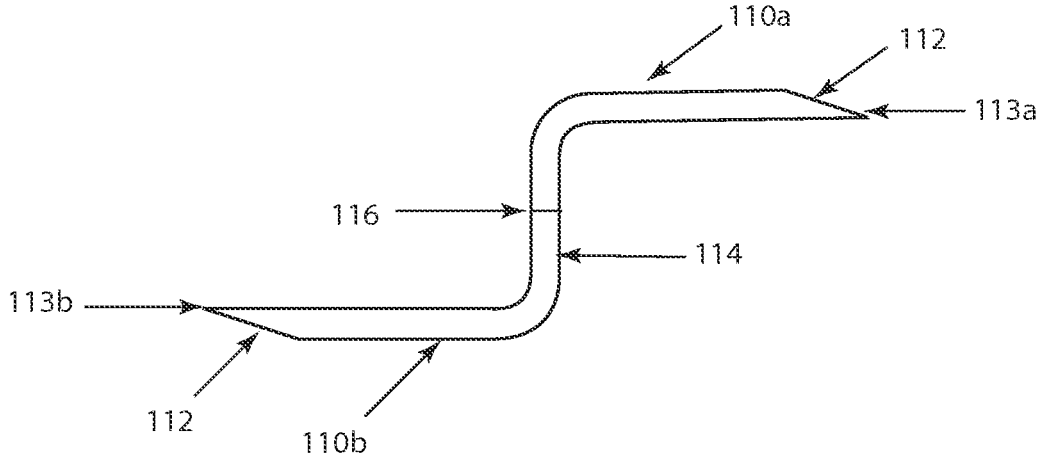
FIG. 3B a rear profile of the folded archery broadhead.

FIGS. 3A and 3B are another embodiment of the blade 102 of the broadhead system of the present invention. FIG. 3A depicts the blade 102 blank prior to folding, having primary blades 110*a* and 110*b* and secondary bleeder blade section 114. The blank 102 is substantially wider tip to tip 113*a* to 113*b* before the compound broadhead is folded as shown in FIG. 3B. This pre-folded cutting width is equally as wide as many of the mechanical broadhead points currently available in the market, without the expense and durability issues. As shown, blade 102 includes cutting edge 112, mounting hole 121, a tail cutout 126 to securely attach to the ferrule (not shown), and surface relief cutouts 130 and 131. The surface relief cutouts 130 and 131 may be used to reduce the surface area of the primary blade 110*a*, 110*b* and the secondary bleeder blade 114, this may improve the flight characteristics of the blade 102 and reduce the overall weight. Blade 102 includes a ground point 116, a single bevel edge 112 and a ground edge 112*a* at base 118. As shown in FIG. 3B, blade 102 with the single bevel edge 112 would impart a right hand twist on impact.

Figure 4:
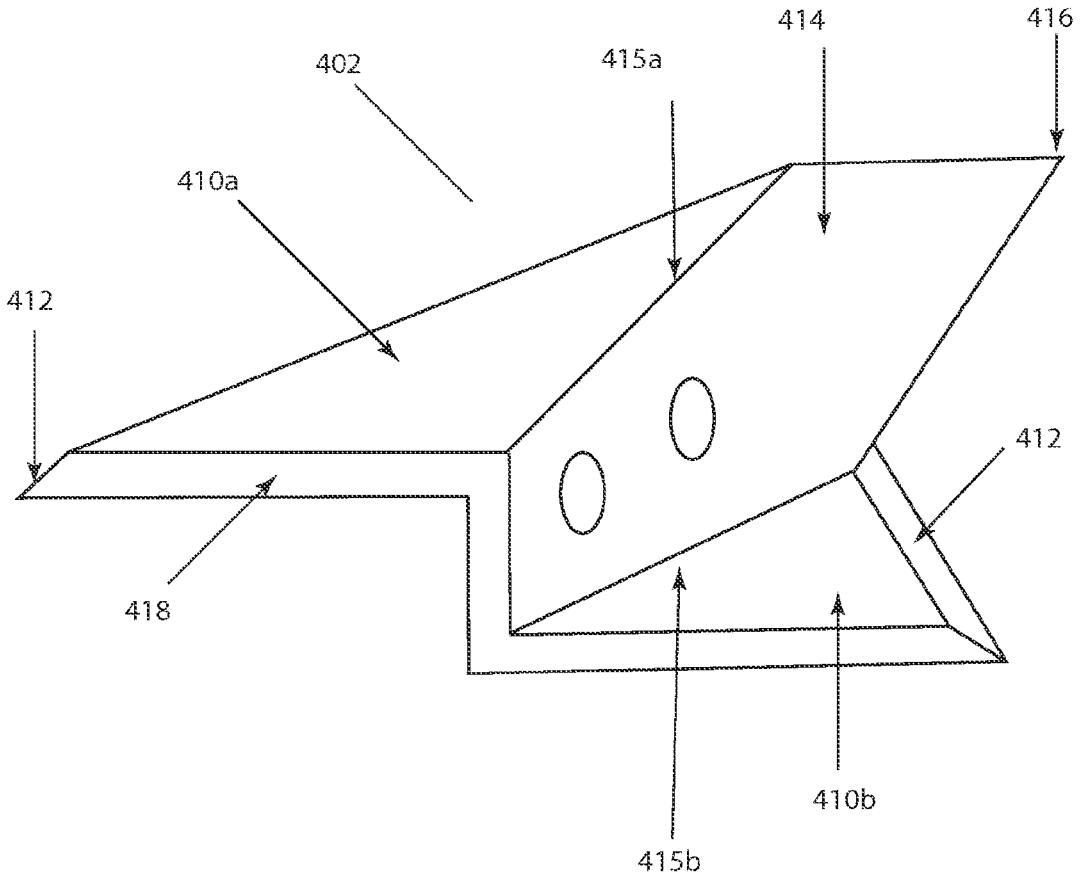
FIG. 4 one embodiment of the archery broadhead blade.

Depicted in FIG. 4 is one embodiment of the blade 402 of the present invention having primary blades 410*a*, 410*b* on offset planes to change the cutting characteristics of the blade 102. It is postulated that the offset planes will reduce penetration but may also enhance twist upon impact and increase soft tissue damage. In the embodiment depicted, the fold lines 415*a* and 415*b* converge toward the base 418. Blade 402 includes; primary blades 410*a* and 410*b*, a secondary bleeder blade 414, single bevel cutting edge 412, point 416 and base portion 418. It is contemplated that blade 402 is best suited for small game animals.

Figure 5:
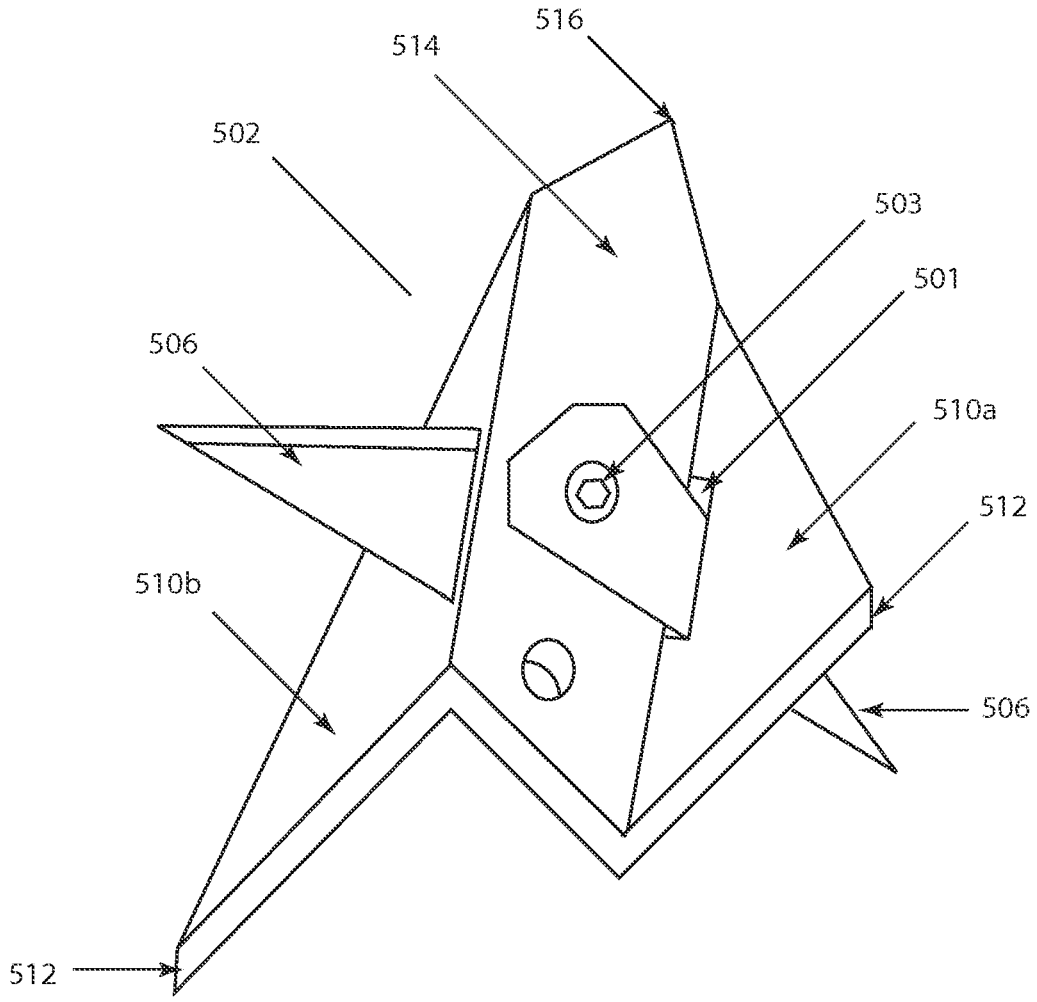
FIG. 5 one embodiment of the archery broadhead blade having tertiary bleeder blades, FIG. 6 one embodiment of the archery broadhead blade, FIG. 7 one embodiment of the archery broadhead blade, FIGS. 8A and 8B one embodiment of a multi-blade archery broadhead, and, FIG. 8C is the central secondary blade of the multi-blade archery broadhead.

FIG. 5 is one embodiment of the blade 502 of the present invention including a point 516, primary blades 510*a*, 510*b*, a central secondary bleeder blade 514, and edge 512. Blade 502 also includes replaceable bleeder blades 506, the replaceable blades are inserted through a slot 501 formed in the primary blades 510*a* and 510*b* and secured to the ferrule (not shown), through the secondary blade 514, using a set screw 503. The replaceable bleeder blades 506 increase the cutting edge surface, increase wound efficiency and may be removed for easy sharpening.

Figure 6:
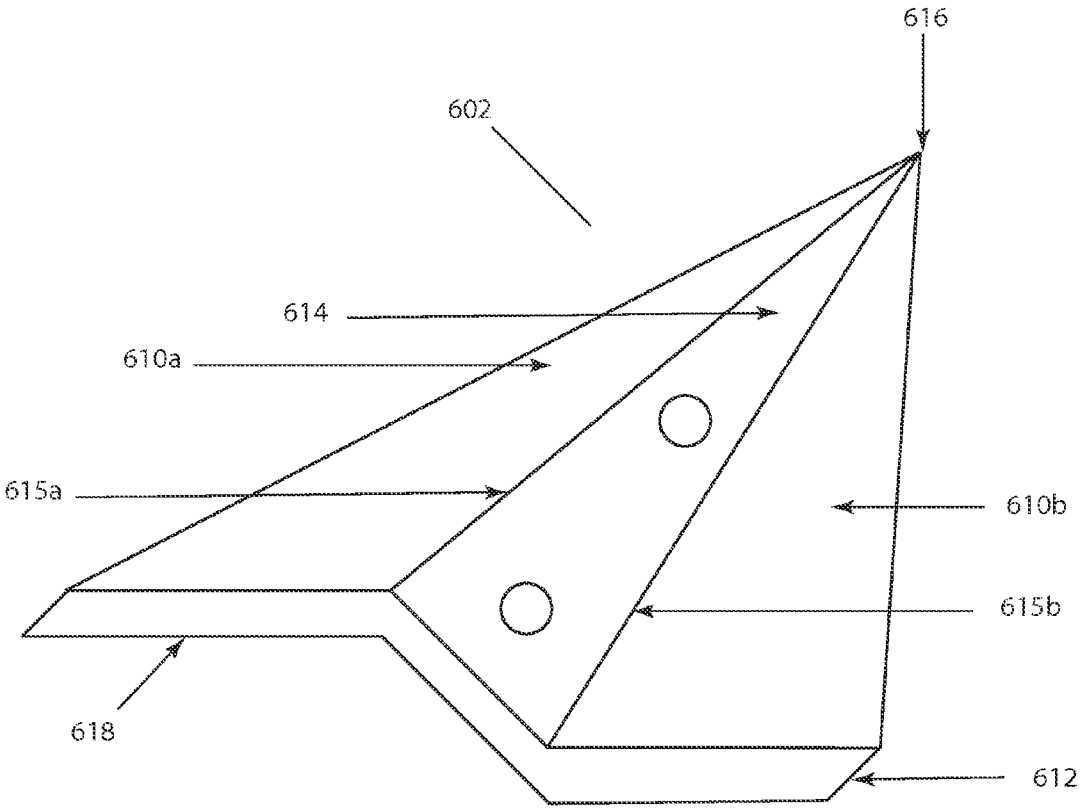

Yet another embodiment of blade 602 of the present invention is shown in FIG. 6. Blade 602 including, a point 616, primary blades 610*a*, 610*b*, secondary blade 614, and base 618. The fold lines 615*a* and 615*b* begin at the point 616 and diverge toward the base portion 618. This creates two progressively offset cutting paths and a narrow front profile for optimal penetration and bone breaking ability, and the surface area of the primary blades 610*a*, 610*b*, in conjunction with the single bevel cutting edge 612 will create optimal twist both during flight and upon impact with a viscous material. As shown fold lines 615*a* and 615*b* form an obtuse angle, however, it is recognized the effective angle may vary.

Figure 7:
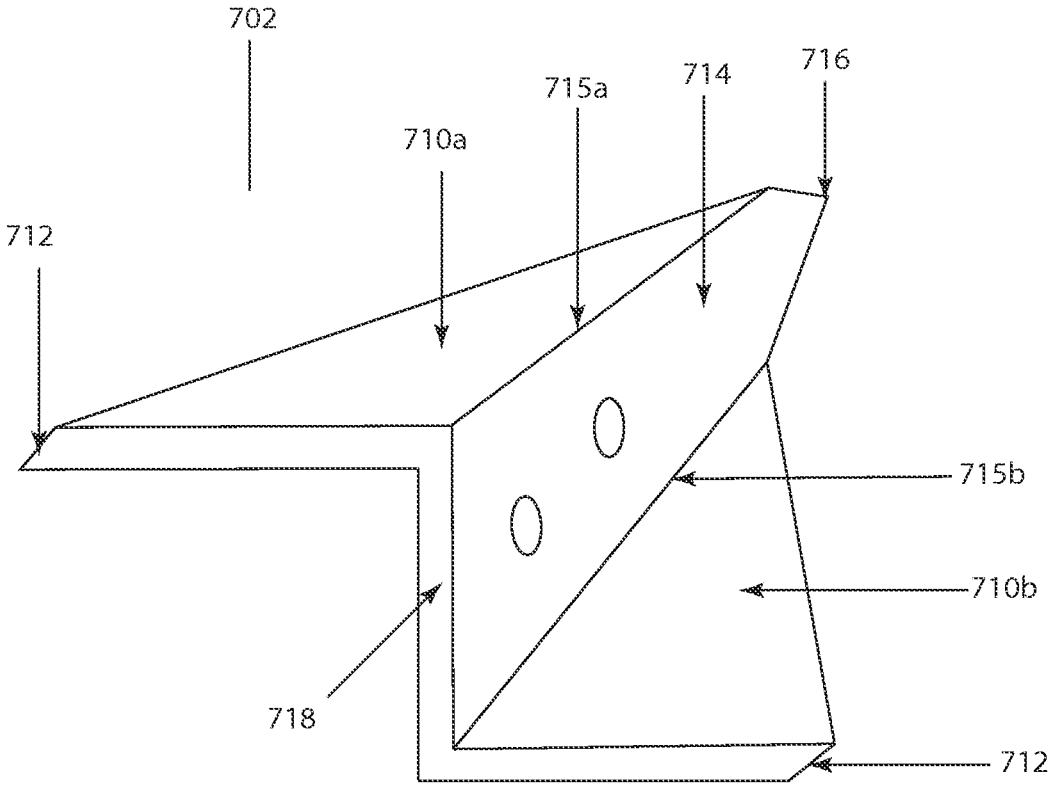

FIG. 7 is another embodiment of blade 702 having divergent primary blades 710*a*, 710*b*, again creating optimal twist during flight and additional torsional force after impact. Blade 702 including, point 716, primary blades 710*a*, 710*b*, a secondary bleeder blade 714, divergent fold lines 715*a*, 715*b*, and base 718.

Figure 8A:
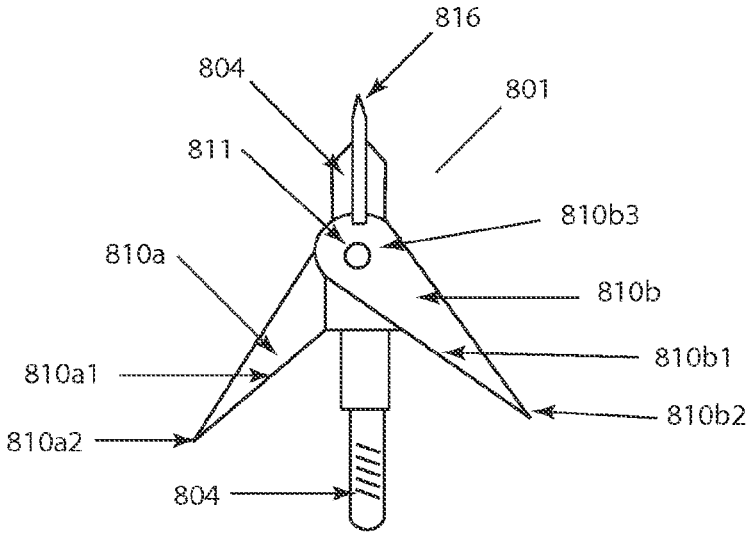
Figure 8C:
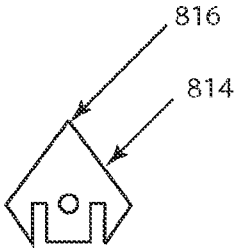
Figure 8B:
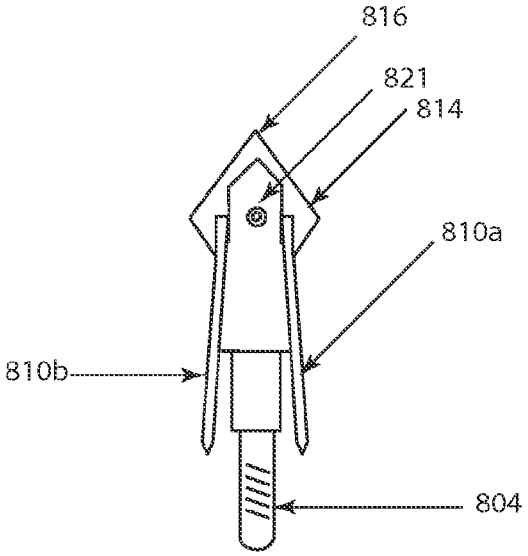

An embodiment of the present invention or broadhead system 801 having replaceable blades 810*a*, 810*b* and 814 is shown in FIGS. 8A, 8B and 8C. Broadhead system 801 includes a ferrule 804 configured to receive a plurality of replaceable or removable blades including secondary bleeder blade 814, having point 816 and primary blades 810*a* and 810*b*. The secondary bleeder blade is attached to ferrule 804 using a set screw 821 and the primary blade are attached to the ferrule using set screws 811 or a similar device. As shown, the primary blades 810*a* and 810*b* are axially offset from an axis extending through the point 816 and the centerline of ferrule 804 and the secondary bleeder blade 814 is arranged perpendicular to the plane of the primary blades 810*a* and 810*b*. This configuration will create the effective "Z" shaped cutting path of the all the broadhead embodiments of the present invention but also having the convenience of blades that are removable when damaged or when they require sharpening. Primary blades 810*a*, 810*b* include a trailing point 810*a*2, 810*b*2, inside edge 810*a*1, 810*b*1 and an attachment portion 810*a*3, 810*b*3.

It is to be understood that the above mentioned arrangements are only illustrative of the application of the principles of the present disclosure. Numerous modifications or alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

The invention claimed is:

1. A broadhead system comprising:
a ferrule assembly including;
an outside diameter, and,
a central axis,
a pair of axially offset primary blades,
the primary blades including;
a planar surface forming a triangle,
the triangle having,
a tapered outside cutting edge,
an inside edge, and,
a base edge,
the primary blades positioned in a tangentially opposing configuration to the outside diameter of the ferrule with the inside edge in the same plane as the central axis,
a planar secondary bleeder blade positioned transverse to the planar surface of the primary blades, and,
the secondary bleeder blade in the same plane as the inside edge of the primary blades and the central axis of the ferrule.

2. The broadhead system of claim 1 wherein the primary blades and the secondary bleeder blade are formed as a single unit.

3. The broadhead system of claim 2 wherein the single unit is formed by machining a solid block of material.

4. The broadhead system of claim 1 wherein tapered outside cutting edge has a single bevel facing away from the central axis of the ferrule.

5. The broadhead system of claim 1 wherein the tapered outside cutting edge has double bevel.

6. A broadhead system comprising:
a ferrule assembly including;
a point end having a blade slot,
an arrow attachment end,
an outside diameter, and,
a central axis,
a broadhead blade formed by folding a triangular shaped blank including:
the triangular shaped blank having;
a central axis,
a point,
two tapered outside cutting edges, and,
a base,
forming a first primary blade by forming a first fold, having a first angle, offset from, and substantially parallel with, the central axis, in a first direction,
forming a second primary blade by forming a second fold, having a reciprocal angle to the first angle, offset from, and substantially parallel with the central axis on the opposite side of the central axis and in the opposite direction from the first direction, and,
the portion of the blank between the folds forming a secondary bleeder blade, the broadhead blade configured to be inserted into the ferrule blade slot, and, an attachment mean to secure the broadhead blade within the ferrule blade slot.

7. The broadhead system of claim 6 wherein the attachment means is one of set screws, pins, adhesive and welding.

8. The broadhead system of claim 6 wherein the first angle and the reciprocal angle of the second primary blade is 90 degrees.

9. The broadhead system of claim 6 wherein the first angle and the reciprocal angle of the second primary blade is one of, greater than 90 degrees and less than 180 degrees.

10. The broadhead system of claim 6 including replaceable bleeder blades co-planar with the secondary bleeder blade and extending through the primary blades.

11. The broadhead system of claim 6 wherein the first fold and the second fold are parallel with the central axis of the triangular blank.

12. The broadhead system of claim 6 wherein the first fold and the second fold converge toward the point of the triangular blank.

13. The broadhead system of claim 6 wherein the first fold and the second fold converge toward the base of the triangular blank.

14. The broadhead system of claim 6 wherein tapered outside cutting edge has a single bevel facing away from the central axis of the ferrule.

15. The broadhead system of claim 6 wherein the tapered outside cutting has double bevel edge.

16. The broadhead system of claim 6 wherein the triangular blank includes surface cutouts.

17. A broadhead system comprising:

a ferrule assembly including;

a point end having a blade slot, an arrow attachment end, an outside diameter having opposing primary blade platforms, the blade platforms perpendicular to the blade slot, the blade platforms and blade slot having a blade attachment means, and, a central axis, a secondary bleeder blade, the secondary bleeder blade having a substantially triangular shape having;

a point, tapered cutting edges, and, a base, the base configured to be received within the ferrule blade slot, a first and second primary blades having;

a leading cutting edge, an inside edge, an attachment portion, and, a trailing point, the secondary bleeder blade removably attached using an attachment means within the ferrule blade slot, and, the primary blades removably attached to the ferrule blade platforms in an opposing configuration using an attachment means.

18. The broadhead system of claim 17 wherein the attachment means for the secondary bleeder blade and primary blades is one or more set screws.

19. The broadhead system of claim 17 wherein the secondary bleeder blade and the primary blades are replaceable.

20. The broadhead system of claim 17 wherein the cutting edge of the secondary bleeder blade and the cutting edge of the primary blades is single bevel facing away from the central axis of the ferrule.

* * * * *